US009845934B2

(12) United States Patent
Schwaighofer et al.

(10) Patent No.: US 9,845,934 B2
(45) Date of Patent: Dec. 19, 2017

(54) LIGHTING ARRANGEMENT, IN PARTICULAR FOR ESCAPE ROUTE LIGHTING

(75) Inventors: Andreas Schwaighofer, Dornbirn (AT); Tanja Illic, Dornbirn (AT); Marcel Kilga, Götzis (AT); Patrik Gassner, St. Gerold (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 82 days.

(21) Appl. No.: 14/345,357

(22) PCT Filed: Sep. 14, 2012

(86) PCT No.: PCT/EP2012/068027

§ 371 (c)(1),
(2), (4) Date: Oct. 16, 2014

(87) PCT Pub. No.: WO2013/037929

PCT Pub. Date: Mar. 21, 2013

(65) Prior Publication Data

US 2015/0036340 A1 Feb. 5, 2015

(30) Foreign Application Priority Data

Sep. 16, 2011 (DE) ..... 10 2011 082 844

(51) Int. Cl.
*F21V 14/06* (2006.01)
*F21V 5/08* (2006.01)
(Continued)

(52) U.S. Cl.
CPC ..... *F21V 5/08* (2013.01); *F21V 5/045* (2013.01); *F21V 17/002* (2013.01); *G08B 7/062* (2013.01);
(Continued)

(58) Field of Classification Search
CPC ..... F21V 5/08; F21V 5/045; F21V 17/002; F21Y 2103/003; G08B 7/066;
(Continued)

(56) References Cited

U.S. PATENT DOCUMENTS 709,849 A * 9/1902 Man ..... 359/593
5,509,223 A * 4/1996 Jung ..... G09F 13/14 362/297

(Continued)

FOREIGN PATENT DOCUMENTS

| | | | |
|---|---|---|---|
| DE | 698 30 937 | T2 | 5/2006 |
| DE | 20 2006 014 352 | U1 | 1/2007 |
| DE | 10 2006 016 021 | A1 | 10/2007 |
| DE | 202010004775 | U1 | 9/2011 |
| EP | 1 519 104 | A1 | 3/2005 |
| EP | 1850061 | A1 | 10/2007 |
| WO | WO-2009/015605 | A1 | 2/2009 |

OTHER PUBLICATIONS

International Search Report for PCT/EP2012/068027, dated Jan. 18, 2013.

*Primary Examiner* — Y M. Lee
(74) *Attorney, Agent, or Firm* — Marshall, Gerstein & Borun LLP

(57) ABSTRACT

In a lighting arrangement, in particular for escape route lighting, comprising a light source and an optical element assigned to the light source, said optical element being designed to emit asymmetrically the light emitted by the associated light source, the optical element can be positioned in different ways.

19 Claims, 2 Drawing Sheets

(51) Int. Cl.

| | |
|---|---|
| ***F21V 17/00*** | (2006.01) |
| ***G08B 7/06*** | (2006.01) |
| ***F21V 5/04*** | (2006.01) |
| ***G09F 13/18*** | (2006.01) |
| *F21W 111/02* | (2006.01) |
| *G09F 13/04* | (2006.01) |
| *F21Y 103/10* | (2016.01) |
| *F21Y 115/10* | (2016.01) |

(52) U.S. Cl.
CPC ..... *G08B 7/066* (2013.01); *G09F 13/18* (2013.01); *F21W 2111/02* (2013.01); *F21Y 2103/10* (2016.08); *F21Y 2115/10* (2016.08); *G09F 2013/0459* (2013.01); *G09F 2013/1822* (2013.01); *G09F 2013/1831* (2013.01)

(58) Field of Classification Search
CPC . G08B 7/062; G09F 13/18; G09F 2013/1831; G09F 2013/0459; G09F 2013/1822; F21W 2111/02
See application file for complete search history.

(56) References Cited

U.S. PATENT DOCUMENTS

| | | | | |
|---|---|---|---|---|
| 7,766,509 | B1 | 8/2010 | Laporte | |
| 8,348,462 | B2 * | 1/2013 | Vasta et al. | F21S 8/08 362/249.02 |
| 9,080,747 | B1 * | 7/2015 | Hetrick | F21V 14/06 |
| 2005/0205878 | A1 * | 9/2005 | Kan | 257/80 |
| 2005/0286249 | A1 | 12/2005 | Weigert | |
| 2007/0058378 | A1 | 3/2007 | Moriyama et al. | |
| 2008/0276509 | A1 * | 11/2008 | Yu | F21V 23/04 40/570 |
| 2009/0002990 | A1 * | 1/2009 | Becker et al. | A47F 3/001 362/249.01 |
| 2009/0273935 | A1 | 11/2009 | Woodward | |
| 2009/0290360 | A1 * | 11/2009 | Wilcox et al. | 362/327 |
| 2009/0310356 | A1 * | 12/2009 | Laporte | F21V 5/007 362/239 |
| 2010/0195330 | A1 * | 8/2010 | Schaefer et al. | 362/237 |

* cited by examiner

Lenses aligned diametrically opposed:

Lenses aligned in the same way:

LIGHTING ARRANGEMENT, IN PARTICULAR FOR ESCAPE ROUTE LIGHTING

The present invention relates to a lighting arrangement which above all is suitable for illuminating regions along a straight line. In particular, the invention relates to so-called escape route lighting.

Arrangements for escape route lighting are absolutely essential in relatively large building complexes in order to make it possible for people to leave the building in a safe and reliable manner. In contrast with so-called escape sign luminaires, whose task consists in indicating an evacuation or escape route, the task of escape route lighting consists in illuminating or lighting up the escape route itself in a sufficient way. Even in the event of failure of the usual lighting of the building the identification of obstacles and the like in the region of the escape or evacuation route is to be rendered possible by this means so that also relatively large crowds of people can leave the building or rescue forces can get into the building quickly and efficiently.

Hitherto, usually luminaires that have a so-called simple symmetrical radiation characteristic have been used for escape route lighting. Such a radiation characteristic by way of which the light of the light source(s) is substantially radiated in two directions that are opposed to each other guarantees uniform illumination of the evacuation route on both sides of the luminaire along a straight line. Such luminaires are, for example, mounted at regular intervals along the ceiling of a corridor constituting the evacuation route. A lateral arrangement, for example on walls or the like, is also known, with the light-radiation characteristic then being correspondingly adapted. Basically, however, in such cases it is provided that the light is delivered in two opposite directions so that lighting of an elongate region is attained on both sides of the luminaire.

Light-delivery deviating from this simple symmetrical radiation characteristic would, however, be advantageous for different mounting situations of such luminaires and special courses of the evacuation or escape route. For example, in situations in which the luminaires for escape route lighting are arranged at intersections, branches or bends and/or corners it would be desirable to adapt the light-delivery of the luminaires in a corresponding manner. One-sided illumination of an escape route can also be advantageous, for example, if the means for escape route lighting are integrated into an escape sign luminaire which is mounted above an emergency exit. In this case, one-sided escape route lighting is significantly more efficient, since in the case of symmetrical radiation a portion of the light would be solely directed towards the wall. Furthermore, one-sided light-delivery is also often advantageous in road tunnels since as a result, for example, a situation can be avoided where people who are escaping are dazzled.

The underlying set object of the present invention is therefore to offer a possibility of being able to adapt the light-delivery in a simple way in lighting arrangements that are provided in particular for escape route lighting. The outlay for adapting the light-radiation characteristic is to be kept as low as possible in this connection and preferably is not to necessitate the use of specially adapted optical elements.

The afore-mentioned object is achieved by means of a lighting arrangement.

The solution in accordance with the invention is based on the idea of using one or more light sources that are arranged so as to lie as close together as possible in order to realize the lighting. Associated with the light source or sources there is in each case an optical element which substantially asymmetrically radiates the light that is emitted from the associated light source. Owing to the fact that this optical element is mounted so that it can be positioned in different ways, in particular rotatably, adaptation of the light-radiation characteristic of the lighting arrangement can be effected in a simple way and in particular without the use of novel or additional components.

In accordance with the invention, consequently a lighting arrangement, in particular for escape route lighting, is proposed that has a light source as well as an optical element associated with the light source. The optical element is in this case designed to radiate asymmetrically the light that is emitted from the associated light source, with it being possible for it to be positioned in different ways in accordance with the invention. The light source is in this case preferably formed by a substantially punctiform light source, in particular by means of an LED.

As already mentioned, preferably a plurality of light sources is provided, arranged at a short distance next to one another and aligned parallel to each other. The optical elements that are associated with the light sources are then in particular of identical construction. The mounting or support of the optical element or elements is then preferably such that they can be positioned in different rotational positions with reference to a longitudinal axis that is defined by the respective light source. Owing to the fact that the optical element or elements is or are, so to speak, rotatably mounted, the direction of the delivered light can be adapted in a simple way, that is, individually for each individual light source. In the event that at least two light sources are used, it is thus possible in a simple way to change from a simple symmetrical radiation characteristic, as it was used hitherto in escape route luminaires in accordance with the embodiments above, to another radiation characteristic which is significantly better suited, for example, for illuminating branches, bends, intersections and the like. It would also be possible to align the optical elements in a similar way so that the light is delivered merely in a single direction. In this connection, means are preferably provided by way of which preferred positions for the optical element or elements are defined. In particular these can be latching elements which are arranged, on the one hand, on the optical element and, on the other hand, on a carrier for the optical element.

The optical element itself or optical elements themselves is or are preferably formed in each case by means of a lens. In the case of the use of a punctiform light source, in this connection the lens can have a cavity facing the light source. The arrangement of the lens is then effected in such a way that the light source projects a short way into this cavity, with the lateral and base surface of the cavity then forming the light-entry surface for the lens. It has been shown that with such a configuration the light that is delivered from the light source, for example from an LED, can be utilized in an effective way. The light-exit region of the lens in turn is configured in such a way that the asymmetrical light-delivery that is striven for is attained. It would be possible in this connection in particular to utilize a so-called Fresnel structure, which leads to a reduction in the overall height.

In accordance with an advantageous further development of the invention it can also further be provided that an additional light-influencing element is used that can be mounted on the lens in a rotatable manner, for example. This can be a transparent lens, plastics rings or reflectors, or semi-mirrors, partly coated with aluminium or similar by vapour deposition. With the aid of this additional element the light-delivery could then further be adapted to the special requirements. In this case, the lens or the first optical element need not then necessarily deliver light asymmetrically, but could also bring about symmetrical light-delivery. The additional element can thus be utilized, for example, to change between symmetrical and asymmetrical light-delivery or vice versa.

In accordance with this aspect, lighting arrangement, in particular for escape route lighting, is thus also proposed that has at least one light source as well as an optical element associated with the light source, wherein the optical element can be positioned in different ways, and associated with the optical element there is an additional light-influencing element which can be set in particular onto the optical element and preferably can be mounted thereon in a rotatable manner.

A particularly preferred example of application of the lighting arrangement in accordance with the invention consists, as already explained, in utilizing it to illuminate escape routes. In this connection, in particular it can be provided that the lighting arrangement is integrated in a luminaire as an extension, wherein the carrier for the optical element or elements is then formed by a housing portion of the luminaire. In particular, it would be possible in this case for the luminaire to be an escape sign luminaire, wherein then in this way a particularly simple and elegant indication, on the one hand, and illumination of an escape route, on the other hand, are rendered possible. The concept in accordance with the invention, however, is not limited to the illumination of escape routes, but can basically be used whenever the light-radiation characteristic of a lighting arrangement is to be adapted in a simple way.

BRIEF DESCRIPTION OF DRAWINGS

The invention will be explained in greater detail in the following with reference to the enclosed drawing, in which:

FIG. 1 shows, as a preferred example of application and exemplary embodiment, a so-called escape sign luminaire, provided with reference numeral 100, that is used to present an evacuation route. In a known way, this luminaire 100 has a circumferential frame 101, which is used to support one or two transparent panes 102 for light-delivery. The frame 101 and the panes 102 form a housing of the luminaire 100 in whose interior space light sources are arranged. The light is then delivered by way of the transparent panes 102, with the panes 102 containing a pictogram by way of which, for example, the direction of the evacuation route is indicated. Such escape sign luminaires are already sufficiently well known and are arranged at relevant positions within a building or the like in order to indicate evacuation routes. The light-delivery can then be effected on one side or two sides, depending on whether the luminaire is arranged in the centre of a room or corridor or on the wall above an emergency exit.

Figure 1:
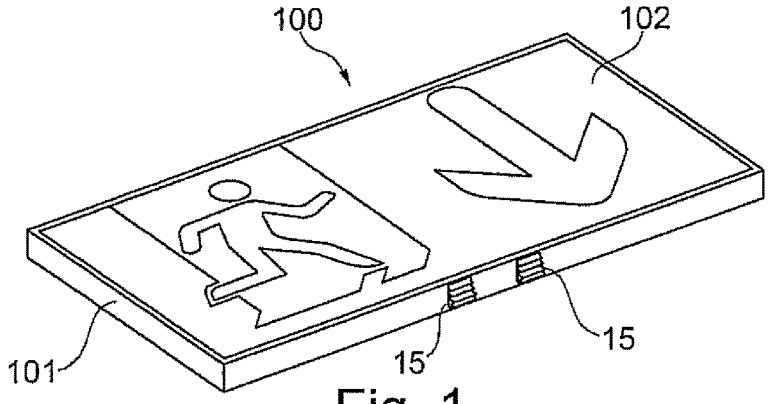
FIG. 1 shows the view of an escape sign luminaire in which the lighting arrangement in accordance with the invention has been integrated in order to illuminate an escape route.

The special feature of the escape sign luminaire 100 shown in FIG. 1 consists in the fact that in addition it also has means for illuminating the escape route. In the present case, these means are integrated into the luminaire 100, although they could of course also be used independently of such an escape sign luminaire 100. Integration affords in a particularly simple and elegant way the possibility of not only indicating an escape route, but also of lighting it.

The means in accordance with the invention of illuminating the escape route consist, in the exemplary embodiment shown, of two light sources and also of optical elements respectively associated with the light sources. The light sources are preferably formed by LEDs 10, which are arranged within the luminaire 100 and are supplied with current by suitable means that are not described further. Associated with each LED 10 there is an optical element in the form of a lens 15 by way of which the light emitted from the LED 10 is delivered. The lenses 15 in this connection are arranged on the frame 101 of the escape sign luminaire 100 and engage in particular into corresponding openings 105 of the frame 101.

Figure 2:
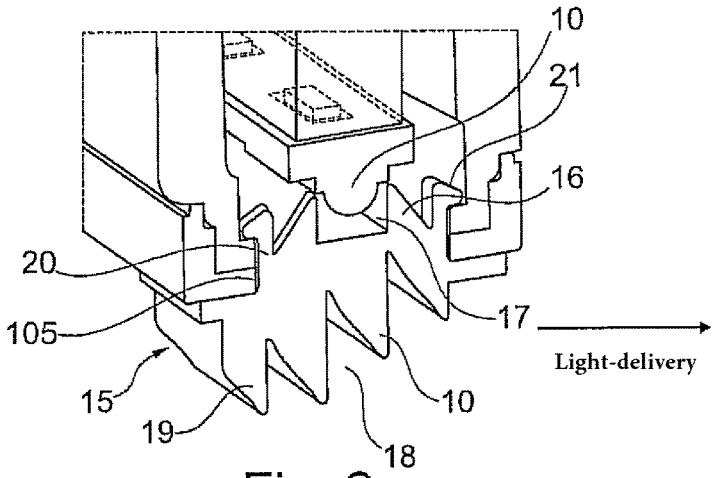
FIG. 2 shows the arrangement of the optical element for asymmetrical light-delivery in the case of the luminaire of FIG. 1 in a sectional representation.
Figure 3:
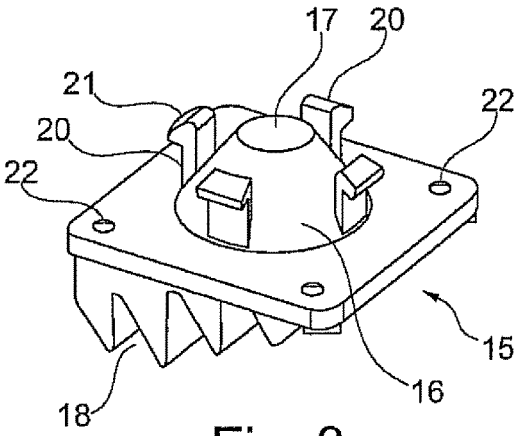
FIGS. 3 and 4 show views of the lens that is used in the case of the lighting arrangement in accordance with the invention.
Figure 4:
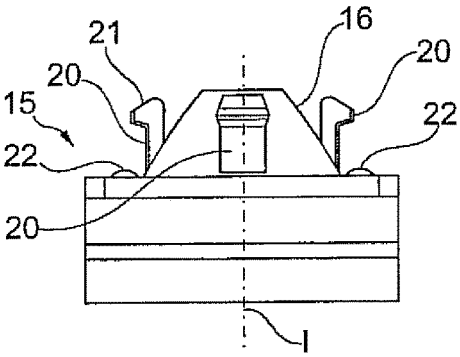

The more precise configuration of the lenses 15 can also be inferred in particular from FIGS. 3 and 4. An object of these lenses 15 is to receive the LED light in an efficient way and to radiate it in a desired direction. For this purpose, the lenses 15, which are of identical construction, in the first instance each have a conical region 16 facing the LED 10. This conical region 16 is provided with a cavity 17 into which the LED 10 easily projects in the final assembly state (see FIG. 2). As a result of this arrangement it is guaranteed that the light that is emitted from the LED 10 is almost completely delivered by way of the lens 15 and can thus be influenced in a desired way. The lateral surface and base surface of the cavity 17 consequently form a light-entry surface for the lens 15, wherein the base surface is preferably formed so as to be slightly curved, this having the advantage that the light falls substantially in parallel onto the light-exit region 18 of the lens 15 and consequently can be influenced in an effective manner.

This light-exit region 18 of the lens 15 is configured in such a way that asymmetrical light-delivery is attained; the light is thus deflected and delivered in a targeted manner in a specific direction. In the exemplary embodiment shown, the light-exit region 18 of the lens 15 is provided with a so-called Fresnel structure for this. It thus has a plurality of fins 19 which are arranged next to one another in parallel and are formed in a wedge-shaped manner and by way of whose flanks the light is influenced in such a way that the asymmetrical light-radiation that is striven for is attained. To be exact, in the present case the light is reflected totally at the inclined flanks of the fins 19 in such a way that light-delivery as indicated in FIG. 2 results.

The use of this Fresnel structure has the advantage that the overall height of the lens 15 can be reduced. The light-exit side of the lens 15 could, however, also be shaped in another way in order to attain the asymmetrical light-radiation that is striven for. A wedge-like configuration or a cylindrical structural form which is cut across an oblique surface would also be possible, for example.

The support of the lens 15 in the assembly opening 105 of the frame 101 is effected with the aid of four snap-action arms 20 which are arranged so that they are distributed over the periphery of the conical region 16 of the lens 15. These snap-action arms 20 have a certain flexibility so that they can yield easily when the lens 15 is pushed in from the underside. If the lens 15 is inserted sufficiently deeply, the arms 20 snap outwards and engage with corresponding latching lugs 21 behind corresponding projections that can be formed on the frame 101 or—as shown—on the lateral panes 102 of the escape sign luminaire 100.

The possibility then exists in accordance with the invention, for each of the two lenses 15, to position the lens 15 in various rotational positions in relation to a longitudinal axis I (see FIG. 4), which is defined by the alignment of the associated LED 10. As a result of the rotationally symmetrical configuration of the region 16 of the lens 15 that faces the LED 10 and also the arrangement of the latching arms 20 the lens 15 can then be turned freely with respect to this axis I so that in principle any position would be possible. Specific preferred positions are, however, preferably defined in which the lens 15 is additionally latched with the housing of the luminaire 100. In the example shown, additional knobs 22 are provided for this on the lens 15 which, when one of these preferred positions is reached, engage into corresponding depressions—not shown—that are formed on the frame 102. In accordance with the arrangement of the knobs 22 shown, there are therefore four preferred positions, which are respectively rotated by 90° with respect to each other. In other words, the lens 15 can be secured to the frame 101 of the luminaire 100 whilst being aligned in four different directions.

Other possibilities of defining corresponding preferred positions for the lenses would also be possible. Thus, for example, the assembly opening in the frame 101 could be formed not so that it is circular, but as a polygon, wherein then as a result of corresponding configuration of, for example, the latching arms 20 insertion of the lens 15 is only rendered possible in specific positions. Furthermore, it would also be possible for no preferred positions at all to be defined, but instead for the lens 15 to be able to be turned freely, except that because of corresponding jamming between the lens and the housing frame 101 the lens 15 is guaranteed to remain in the set position. It is, however, fundamentally important that the possibility exists of setting the radiation direction of the light freely by corresponding selection of the position of the lens 15.

Figure 5A:
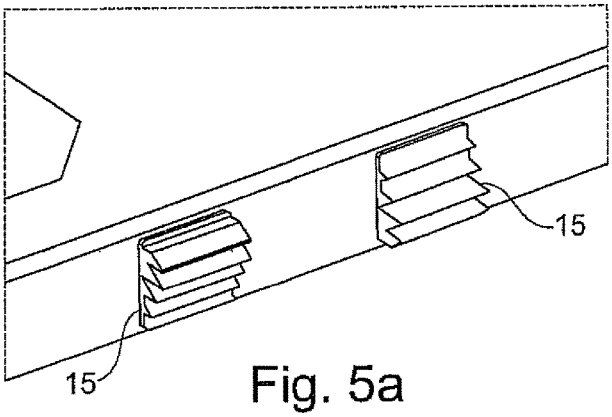
FIGS. 5*a* and 5*b* show two alternative arrangements of the optical elements in the case of the escape sign luminaire shown in FIG. 1.
Figure 5B:
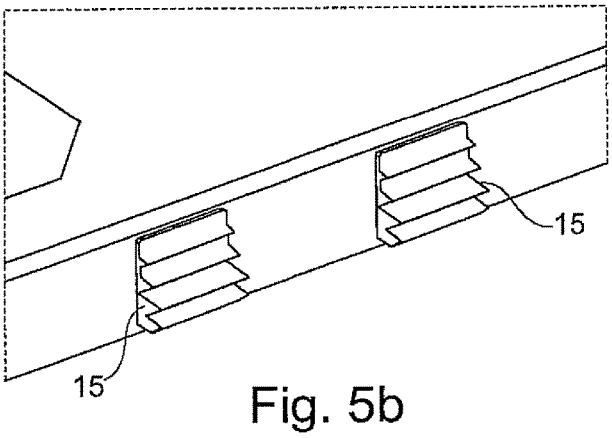
Figure 6A:
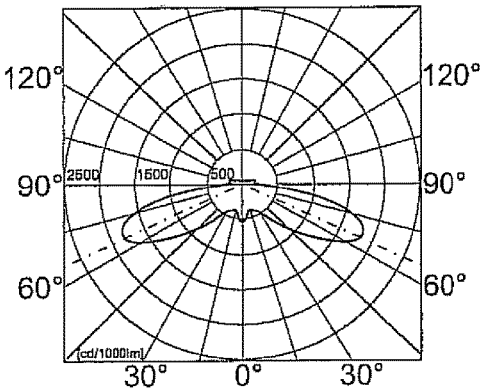
FIGS. 6*a* and 6*b* show the light-distribution curves that result with the arrangements of the lenses according to FIGS. 5*a* and 5*b*.

The possibility therefore now exists, for example, of aligning the two lenses 15, as shown in FIGS. 5*a* and 5*b*. Whilst in the case of the variant in accordance with FIG. 5*a* the lenses 15 are diametrically opposed, that is, they are oriented so as to be turned by 180° with respect to each other, the lenses in FIG. 5*b* are aligned in the same way. In the case of the arrangement in accordance with FIG. 5*a*, a light-radiation characteristic, as it is shown in FIG. 6*a*, then results overall for the lighting arrangement. Symmetrical light-delivery extending in two directions is thus attained. This corresponds to the light-delivery as was hitherto used in most cases in escape route lighting. Such a light-radiation characteristic would thus be suitable in particular in such cases in which the escape sign luminaire 100 is located substantially in the centre (viewed in the longitudinal direction) of an escape route that is to be illuminated. A section of the escape route is then illuminated with the aid of the lighting arrangement in accordance with the invention on both sides of the luminaire 100.

Figure 6B:
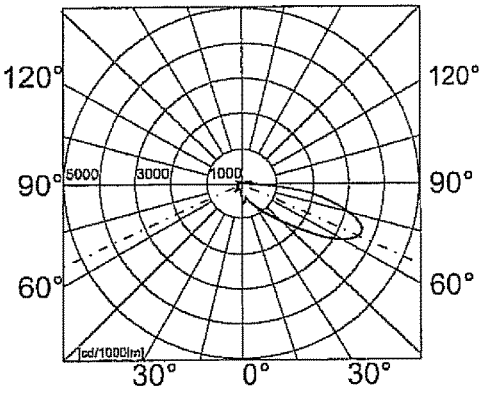

In the position in accordance with FIG. 5*b*, on the other hand, the light is delivered through both lenses 15 in the same direction, and the asymmetrical light-radiation characteristic that is shown in FIG. 6*b* results. This is suitable in particular in such cases in which the escape sign luminaire 100 is located above an emergency exit, and the region of the escape route towards the emergency exit is to be illuminated.

It is obvious, furthermore, that the lighting arrangement in accordance with the invention in particular is also very well suited for illuminating bends or corners of an escape route. In this case, the lenses would have to be aligned in such a way that the light-delivery follows in two beams turned by 90°. Furthermore, it would also be possible for more than two light sources with associated lenses to be used in order to be able to illuminate, for example, branches, intersections or the like. In all cases, however, the use of specially configured optical elements is not necessary; instead the adaptation of the light-radiation characteristic can be effected solely by corresponding setting of the lenses. This means that the light-radiation characteristic can be adapted to special wishes very simply and effectively and, in particular, however, also cost-effectively.

Furthermore, it would also basically be possible within the scope of the present invention for merely one single light source with associated adjustable optics to be used. Admittedly in this case merely illumination along a straight line or a line is possible, that is, bends or corners of an evacuation route cannot be illuminated so well, yet the possibility still exists of changing the alignment of this straight line or line. For example, this would be helpful if a tunnel that is not straight, but follows a bend or curved track is to be illuminated.

A possible further development of the invention can also consist in using a further or additional element that influences the light and is arranged downstream of the optical element in the light path. This additional light-influencing element could, for example, be mounted in a rotatable manner onto the lens—which is preferably still arranged on the housing so that it can be positioned in a rotatable manner or in different positions, as described above. These elements can then be transparent lenses, plastics rings or reflectors, partly coated with aluminium or similar by vapour deposition, or semi-mirrors, that is, elements which are partly permeable to light and partly mirror-coated. With the aid of these additional elements, the light-delivery could then be further adapted to the special requirements. Thus, for example, the direction of the lighting could be fixed by means of the first lens, and the width and/or horizontal inclination of the light beam could be set with the aid of the additional light-influencing element.

This further development just described is of course also possible both in the case of the use of a single light source and in the case of the employment of a plurality of light sources. Furthermore, in this case the lens, that is, the first optical element, need not necessarily deliver light asymmetrically, but could also bring about symmetrical light-delivery. In this case, the additional element could be utilized, for example, to change between symmetrical and asymmetrical light-delivery or vice versa.

Finally, it is also to be pointed out that the concept in accordance with the invention is not limited to the illumination of escape routes, but could also be used in other cases in which adaptation of the light-distribution characteristic is desired. In particular, use as a so-called wallwasher with which wall regions are illuminated would also be possible. In this connection, adaptation of the light-radiation can then be effected in a simple way, depending on whether the lighting arrangement is located on the longitudinal side or in a corner region of a room.

The invention claimed is:

1. A lighting arrangement in the form of an escape sign luminaire, the lighting arrangement comprising:

a circumferential frame for supporting one or more transparent panes for light-delivery, wherein the circumferential frame and the one or more transparent panes form a housing;

two light sources arranged in an interior of the housing; and two lenses respectively associated with the light sources, wherein the lenses are designed to asymmetrically radiate light that is emitted from the associated light source, wherein the lenses are arranged on the frame, and wherein the lenses can be positioned in four different positions on the frame, the four different positions rotated 90 degrees relative to one another about a longitudinal axis that is defined by the associated light source, and wherein each of the lenses comprises a base, a first portion that extends outwardly from the base in a first direction, and a second portion that extends outwardly from the base in a second direction opposite the first direction, the first portion defining a light-entry region for the light emitted from the associated light source, and the second portion defining a light-exit region for the light.

2. A lighting arrangement according to claim 1, wherein each light source is substantially formed so as to be punctiform.

3. A lighting arrangement according to claim 2, wherein each light source is substantially formed so as to be punctiform by an LED.

4. A lighting arrangement according to claim 1, comprising means for defining the four different positions for each of the lenses.

5. A lighting arrangement according to claim 4, wherein the means for defining the four different positions for each of the lenses comprises latching elements.

6. A lighting arrangement according to claim 5, wherein the latching elements circumferentially arranged about the longitudinal axis defined by the associated light source.

7. A lighting arrangement according to claim 5, wherein each of the latching elements comprises a first portion that extends in a direction parallel to the longitudinal axis and a second portion that extends outwardly from the first portion.

8. A lighting arrangement according to claim 1, wherein each of the lenses has a cavity which faces the associated light source and a lateral or base surface which forms a light-entry surface of that lens.

9. A lighting arrangement according to claim 1, wherein a light-exit region of each of the lenses has a Fresnel structure.

10. A lighting arrangement according to claim 1, wherein the housing carries the lenses.

11. A lighting arrangement according to claim 1, wherein the light sources are arranged next to one another and are aligned parallel to each other.

12. A lighting arrangement according to claim 1, wherein the lenses are of identical construction.

13. A lighting arrangement according to claim 1, wherein the first portion comprises a conical region and a plurality of latching elements circumferentially arranged around the conical region, the conical region defining a cavity sized to receive a portion of the associated light source.

14. A lighting arrangement in the form of an escape sign luminaire, the lighting arrangement comprising:

a circumferential frame for supporting one or more transparent panes for light-delivery, wherein the circumferential frame and the one or more transparent panes form a housing;

two light sources arranged in an interior of the housing; and two lenses respectively associated with the light sources, wherein the lenses are designed to asymmetrically radiate light that is emitted from the associated light source, wherein the lenses are arranged on the frame, and wherein the lenses can be positioned in four different positions on the frame, the four different positions rotated 90 degrees relative to one another about a longitudinal axis that is defined by the associated light source, and wherein each of the two lenses includes four knobs, each of the four knobs being associated with a different one of the four different positions.

15. A lighting arrangement in the form of an escape sign luminaire, the lighting arrangement comprising:

a circumferential frame for supporting one or more transparent panes for light-delivery, wherein the circumferential frame and the one or more transparent panes form a housing;

two light sources arranged in an interior of the housing; and two lenses respectively associated with the light sources, wherein the lenses are designed to asymmetrically radiate light that is emitted from the associated light source, wherein the lenses are arranged on the frame, and wherein the lenses can be positioned in four different positions on the frame, the four different positions being rotated 90 degrees relative to one another about a longitudinal axis that is defined by the associated light source, the lighting arrangement further comprising latching elements for defining the four different positions for each of the lenses wherein the latching elements are arranged to selectively engage an inwardly extending lug of the frame.

16. A lighting arrangement in the form of an escape sign luminaire, the lighting arrangement comprising:

a circumferential frame for supporting one or more transparent panes for light-delivery, wherein the circumferential frame and the one or more transparent panes form a housing;

at least one light source arranged in an interior of the housing;

at least one lens associated with the at least one light source, the at least one lens being configured to asymmetrically radiate light emitted from the at least one light source, and wherein the at least one lens comprises a base, a first portion that extends outwardly from the base in a first direction, and a second portion that extends outwardly from the base in a second direction opposite the first direction, the first portion defining a light-entry region for the light emitted from the at least one light source, and the second portion defining a light-exit region for the light, and wherein the at least one lens can be positioned in a plurality of different rotational positions on the frame.

17. A lighting arrangement according to claim 16, wherein the plurality of different rotational positions comprises four different positions rotated 90 degrees relative to one another about a longitudinal axis defined by the at least one light source.

18. A lighting arrangement according to claim 16, wherein the first portion comprises a conical region and a plurality of latching elements circumferentially arranged around the conical region, the conical region defining a cavity sized to receive a portion of the associated light source.

19. A lighting arrangement according to claim 16, wherein the second portion comprises a plurality of fins arranged to asymmetrically radiate light emitted from the associated light source.

* * * * *